US005846679A

United States Patent [19]

Kitahara et al.

[11] Patent Number: 5,846,679

[45] **Date of Patent: *Dec. 8, 1998**

[54] ELECTROPHOTOGRAPHIC PHOTORECEPTOR

[75] Inventors: Yohko Kitahara; Eiichi Sakai; Kenichi Yasuda; Hiroaki Minemura; Fumitaka Mochizuki, all of Hachioji, Japan

[73] Assignee: Konica Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 680,478

[22] Filed: Jul. 17, 1996

[30] Foreign Application Priority Data

Sep. 14, 1995 [JP] Japan ..... 7-236929

[51] Int. Cl.[6] ..... G03G 5/04; G03G 5/06

[52] U.S. Cl. ..... 430/65; 430/60; 430/64; 430/78

[58] Field of Search ..... 430/60, 62, 63, 430/64, 65, 78

[56] References Cited

U.S. PATENT DOCUMENTS

| | | | |
|---|---|---|---|
| 5,114,815 | 5/1992 | Oda et al. | 430/78 |
| 5,188,916 | 2/1993 | Hodumi et al. | 430/65 |
| 5,252,422 | 10/1993 | Okano et al. | 430/131 |
| 5,286,591 | 2/1994 | Hongo | 430/60 |

FOREIGN PATENT DOCUMENTS

| | | |
|---|---|---|
| 0 671 663 A1 | 9/1995 | European Pat. Off. . |
| 40 25 759 A1 | 2/1991 | Germany . |
| 2 235 985 | 3/1991 | United Kingdom . |

OTHER PUBLICATIONS

Derwent Publication Ltd., Class E11, AN 92–196180 of JP 04 124 674 A (Apr. 1992).

Patent Abstracts of Japan, vol. 16, No. 386 (P–1404) of JP 04 124 674 A (Apr. 1992).

*Primary Examiner*—Janis L. Dote

*Attorney, Agent, or Firm*—Frishauf, Holtz, Goodman, Langer & Chick, P.C.

[57] ABSTRACT

An electrophotographic photoreceptor containing an intermediate layer provide between a support and a photosensitive layer is disclosed. The intermediate layer contains at least one of an organic metal compound and a silane coupling agent or a product therefrom and its membranaceous index is 0.5 or more and 10 or less. The electrophotographic photoreceptor has low residual potential wherein no image defects such as spotting are caused over a long period of use.

8 Claims, 3 Drawing Sheets

FIG. 3 ( a )
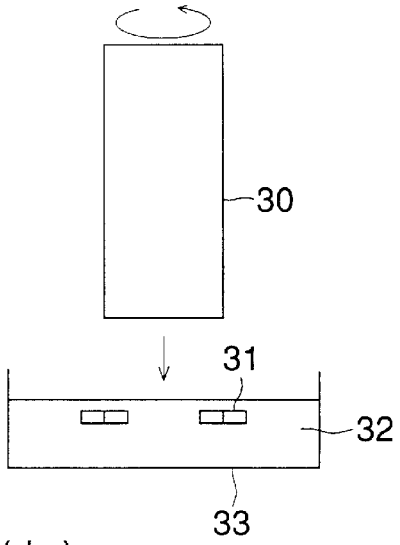
FIG. 3 ( b )
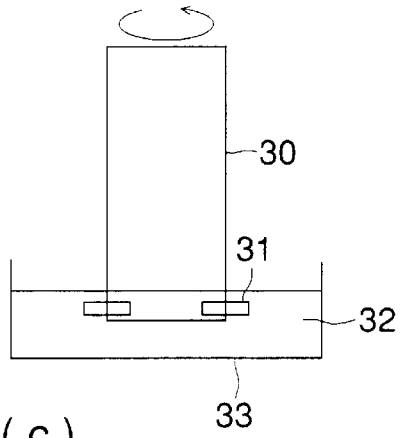
FIG. 3 ( c )
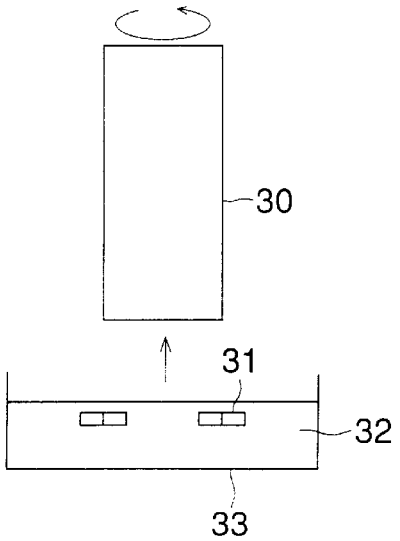

ELECTROPHOTOGRAPHIC PHOTORECEPTOR

FIELD OF THE INVENTION

The present invention relates to an image forming apparatus used for copying machines or printers and to a method of image forming.

BACKGROUND OF THE INVENTION

Heretofore, an electrophotographic system had been used for an image forming apparatus used as a copying machine or a printer and for a method of image forming. These equipment have gradually come to be used for outputting digitized information resulting in tendency that high durability and processing speed are requested.

Accordingly, there is a strong demand for sensitivity and also higher durability of the electrophotographic photoreceptor used therefor.

On the other hand, with regard to a photoreceptor, various photosensitive materials have been used. Recently, inorganic type photoreceptors have gradually been replaced with organic type photoreceptors for the reason of a adverse influence of manufacturing, using and disposal on environment and for the reason of easy mass-production.

In addition, with regard to an intermediate layer (referred to also as "a subbing layer") which is also used in combination with an organic photoreceptor, there is a strong demand for the higher and for those capable of coping with. For such demand, conventional resin type subbing layers such as polyamide is insufficient in terms of electrical potential stability. Therefore, various improvements have been proposed. For example, there are proposals to obtain an appropriate charge blocking property and favorable potential stability by dispersing inorganic fine particles such as silicon dioxide and titanium oxide. In addition, organic metal compounds and silane coupling agents are used, instead of a resin type, for an intermediate layer for improving potential stability.

However, it cannot be said that, so far, there has been established a method to stably obtain an intermediate layer which has moderate charge blocking property and excellent potential stability. This is becoming a serious problem in the field of an electrophotographic type image forming apparatus and a method of image forming.

SUMMARY OF THE INVENTION

An object of the present invention is to provide a countermeasure for the above-mentioned problem, and practically to provide an electrophotographic photoreceptor wherein an image defect such as a spotting does not occur even after use over a long time, an electrophotographic photoreceptor having low residual potential, an image forming method and an image forming apparatus using the same.

The electrophotographic photoreceptor comprises a conductive support having thereon an intermediate layer and a photosensitive layer in this order from the support, wherein the intermediate layer contains at least one of an organic metal compound and a silane coupling agent or a product therefrom and its membranaceous index is 0.5 or more and 10 or less.

The organic metal compound is preferably a compound represented by the following Formula (1) and the silane coupling agent is preferably that represented by the following Formula (2) or a product produced from either:

$$(RO)_m MX_n \quad (1)$$

$$(Z)_a(A)_b Si(Y)_c \quad (2)$$

wherein, in Formula (1), R represents an alkyl group; M represents zirconium, titanium or aluminum; X represents an acetoacetic acid ester residual group or a β diketone residual group; and m and n represent integers of one or more, provided that m+n is 4 when M is zirconium or titanium and m+n is 3 when M is aluminum:

in Formula (2), Z represents a hydrolysis group; A represents an alkyl group or an aryl group; Y represents —BOOCC(R')=$CH_2$, —BNHR" or —$BNH_2$; R' represents an alkyl group; R" represents an alkyl group or an aryl group; B represents an alkylene group or an alkylene group containing —O—, —NH—, —NR'— and —CO—; a and c represent integers of 1 or more; b represents an integer of 0 or more; and a+b+c represent 4.

In the above formula, a metal M of the organic metel compound used in the intermediate layer of aforesaid photoreceptor is preferably titanium or aluminum.

In the electrophotographic photoreceptor, the photosensitive layer preferably contains phthalocyanine compound.

In the electrophotographic photoreceptor, the photosensitive layer preferably contains oxotitanylphthalocyanine.

BRIEF EXPLANATION OF THE DRAWINGS

FIGS. 3(*a*), 3(*b*) and 3(*c*) are schematic views of removing local thick coating.

EXPLANATION OF NUMERALS

Figure 1:
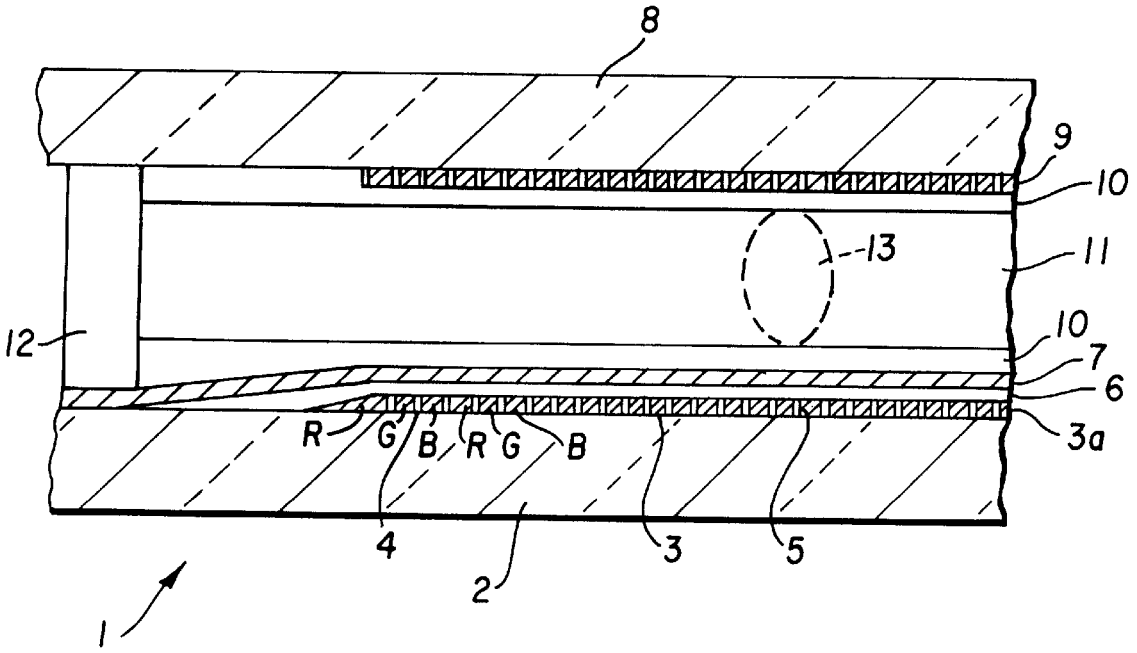
FIG. 1 is a drawing of infrared spectrum (IR) which explains membranous index of the present invention.

1. Laser light source in an image recording unit
4. Photoreceptor drum
5. Charge unit
6. Developing unit
7. Transfer pole
9. Separation pole
10. Fixing device
11. Cleaning device
12. Pre-transfer exposure lamp (PCL)

DETAILED DISCLOSURE OF THE INVENTION

The intermediate layer of the photoreceptor is formed by selecting a material from specific material types and, concurrently with this, by manipulating its membranaceous index. The intermediate layer is formed by dissolving, for example, a compound represented by the formula (1), and a compound represented by the formula (2) and further water if necessary, in a solvent, and the resulted solution is coated on an electrically conductive support and dried. In this process, the hydrolysis group of the compound represented by formula (2) is hydrolyzed. The hydrolyzed compound reacts with the compound represented by formula (1), to form M—O—Si binding, which expands three dimensionally, and gives hard thin coating. The three dimensional binding is supposed to be bridging.

It is considered that, when the intermediate layer of the photoreceptor is made with an organic metal compound and a silane coupling agent, an alkoxy group formed by hydrolysis is condensed for forming a layer bridged with M—O—Si binding formed by the resulting condensation. Here, M represents a metal such as Zr, Ti or Al. The M—O—Si binding has close characteristics to ceramics in the same manner as an inorganic fine particle so that it is considered to have electron conductivity. Accordingly, if there are points where bridging is concentrated, it is considered that blocking property is reduced, causing image defect.

In the conventional art described above, where an inorganic fine particle is dispersed in a resin to form an intermediate layer, it is necessary to optimize the amount of fine particles and the amount of resin. In the same manner, in this system, it is assumed that optimization of ceramic component and an organic component will be necessary.

When a layer formed with the above-mentioned organic metal compound and a silane coupling agent is measured by means of an infrared spectrum (IR) analyzer, a maximum peak is observed in the vicinity of 1000–1100 $cm^{-1}$ (Kayser), shown as (a) in FIG. 1, which is considered to be a peak derived from Si—OR. It is considered that the length of this peak (a) is proportional to the amount of the unbridged end. This end is thought to be an organic component in the layer. The absorbance in this wavelength area is denoted a.

The peak or a shoulder at the wavelength closest to 900 (±50) $cm^{-1}$, shown as (b) in FIG. 1, is considered to be derived from the M—O—Si binding. It is assumed that the amount of ceramic component can be sensed. The absorbance in this wavelength area is denoted b.

Therefore, the peak ratio of a/b is defined to be a membranous index. FIG. 1 is an example showing such a peak, wherein an intermediate layer exhibited in Preparation Example 1 of a photoreceptor was measured by a Micro-Fourier Transform Infrared Spectrometer produced by Japan Spectral Janssen.

The ratio of a/b represents a ratio of organic binding to inorganic binding in the intermediate layer. The smaller value of the ratio becomes, the intermediate layer comprises more inorganic binding and less organic binding, and consequently, the intermediate layer becomes harder.

When the membranous index is smaller than 0.5, it is considered that ceramic abundantly exists. In this occasion, the ceramic portion frequently concentrates at certain portions. In the case of such layer property, image defects such as black spots (white spots) easily occur. On the contrary, when the membranous index is larger than 10, it is assumed that there are abundant unbridged portions and organic components abundantly remain. In such a layer property, potential stability, the specifically stability of remaining potential after repeated use and properties dependent on environmental factor were deteriorated. The reason for this can be estimated that the potential characteristics is identical to that observed in an intermediate layer made of a single resin, because there are abundant organic components so that the layer property is extremely close to the resin-made intermediate layer.

The membranous index depends on the properties of the compounds represented by formulae (1) and (2), their mixing ratio, and/or their reaction degree, and therefore, can controlled by selecting these conditions. In case that the reaction of compounds represented by formula (1) and (2), number of M—O—Si binding formed by the reaction is restrained, and consequently, larger membranous index is obtained. The number of M—O—Si binding formed by the reaction increases according to the progress of the reaction, whereby smaller membranous index is obtained.

Selection of species of solvent, amount of water if used, and drying condition after coating also affect the membranous index. Water in the coating solution assists the progress of hydrolysis reaction and consequently, gives more M—O—Si binding. With reference to drying condition, the higher the temperature is applied, the more number of M—O—Si binding is obtained.

The more preferably membranous index is 1.0 to 10, and most preferably 1.2 to 7. In case that the M in the formula (1) is zirconium, the membranous index is preferably 1.2 to 10, especially, 1.5 to 7.

Next, the constitution of the present invention will further be explained.

The material used for a conductive support (the substrate of a photoreceptor) used for the present invention is not specifically limited. An aluminum alloy which is commonly used today, resins wherein a metal layer is formed by means of depositing or spattering and various substrates coated with conductive resins can be used.

A conductive support will now be explained.

Aluminum and its alloy include pure aluminum, an Al-containing type, an Al-Mn-containing type, an Al-Mg-containing type, an Al-Si-containing type, an Al-Mg-Si-containing type, an Al-Cu-containing type, an Al-Mn-Si-containing type, an Al-Zn-Mg-containing type and Al-Cu-Mg-Si-containing type. Among them, those which exhibit preferable characteristics when being combined with the intermediate layer of the present invention are pure an Al-containing type, an Al-Mn-containing type and an Al-Mg-containing type aluminum alloys. Specifically, the Al-Mg-containing type aluminum alloys is preferable. When the above-mentioned aluminum alloys are used, image defects such as block spots can be reduced even in case that the intermediate layer is thin. Accordingly, a feature that the intermediate layer is little in terms of properties dependent on environmental factor can be utilized so that electrical properties and image properties can become compatible concurrently.

By the use of aforesaid conductive support, a photoreceptor can provide images having high density and favorable image quality without causing fogging or image defects such as black spots or white spots over a long time even when it is used in conventional copying machines using analog light exposure and regular developing process. In addition, when aforesaid conductive support is used in digital light exposure and reversal developing process, noticeable image improvement and stabilization are observed compared with conventional photoreceptors. The reason for such improvements are that, due to relationship between the light exposure and developing mechanism, image defects such as black sports create black spots on a white background I the reversal developing process so that it is very prominent and that distinction with image points due to the digital light exposure is difficult to be observed. Therefore, the above-mentioned defect prevention effects of the present invention may be conspicuous. Therefore, image formation of the present invention, after superposing plural colors on the photoreceptor, due to a process to transfer all colors en bloc can result in desirable image quality.

The absolute value of the charge potential of the photoreceptor prepared in accordance with the present invention is preferably 500 V or high and specifically preferably between 600 V and 900 V.

An intermediate layer (a subbing layer) preferably used is a so-called hardening-type intermediate layer, wherein the main component is an organic metal compound or a silane coupling agent or products formed therefrom, which are diluted with a solvent for forming a coating solution. This solution is coated and dried and hardened for forming the intermediate layer.

As an organic metal compound, a metal alkoxide and a metal chelating compound are cited. As a metal kind, titanium, zirconium or aluminum are cited as ordinary ones.

As the above-mentioned metal alkoxide, tetrapropoxytitanium, tetrabuthoxytitanium, tetrapropoxy aluminum and tetrabuthoxyzirconium are cited.

There are many metal chelate compounds, examples of the chelating group of which are cited:

(1) β-diketones such as acetyl acetone and 2,4-heptanedione, (2) Ketoesters such as methyl acetoacetate, ethyl acetoacetate, propyl acetoacetate and butyl acetoacetate, (3) Hydroxyl carboxylic acids such as butyric acid, salicylic acid and maleic acid, (4) Hydroxyl carboxylic acid esters such as methyl lactate, ethyl salicylate and ethyl maleiate, (5) Glycols such as octane diol and hexane diol, (6) Keto alcohols such as 4-hydroxy-4-methyl-2-pentanone, and (7) Amino alcohols such as triethanolamine.

β-diketone of (1) and aceto acetate of (2) show better properties in every respect including electro-potential property, film-forming performance, adhesion property to the photo-conductive layer, image properties and pot-life of the coating solution.

There is an appropriate range concerning the number of the chlating-forming compound in the organic metal compounds. In the case where the organic metal compound only has a chelate ligand and it does not have any alkoxy group, residual potential tends to become relatively high. Accordingly, it is preferable for an alkoxy group to be contained, and, if possible, it is especially preferable that the number of the chelating groups are either equal to that of the alkoxy group or less. By doing this the residual potential may especially be restrained to a small level.

For the metal in the organic metal compound, zirconium, titanium and aluminum are especially preferable. In this respect, coating solutions of the organic metal compound containing titanium and aluminum have an advantage that they are superior in stability and, therefore, preferable.

Examples of the metal chelate compounds are
diisopropoxytitaniumbis(acetylacetate),
diisopropoxyaluminumbis(acetylacetate),
butoxyzirconiumtri(acetylacetate),
diisopropoxytitaniumbis(ethyl acetoacetate),
diisopropoxyaluminumbis(ethyl acetoacetate),
diisopropoxytitaniumbis(lactate),
dibutoxytitaniumbis(octyleneglycolate) and
diisopropoxytitaniumbis(triethanoleaminate).

The organic metal compound to be used in the interlayer of the invention is one represented by the following Formula 1:

$$(RO)_m MX_n.$$

In the above formula, R is an alkyl group; M is a metal atom selected from titanium, aluminum or zirconium.; X is a chelate ligand; and m and n are each an integer of 0 to 4 and the sum of m and n is 3 for the case M is aluminum, or 4 for the case M is titanium or zirconium.

Among organic metal compounds which are advantageously used in the present invention, titanium chelating compounds containing an acetoacetate chelate ligand include, for example as follows.
diisopropoxytitaniumbis(methyl acetoacetate),
diisopropoxytitaniumbis(ethyl acetoacetate),
diisopropoxytitaniumbis(propyl acetoacetate),
diisopropoxytitaniumbis(butyl acetoacetate),
dibutoxytitaniumbis(methyl acetoacetate)
dibutoxytitaniumbis(ethyl acetoacetate),
triisopropoxytitanium(methyl acetoacetate).
triisopropoxytitanium(ethyl acetoacetate),
tributoxytitanium(methyl acetoacetate),
tributoxytitanium(ethyl acetoacetate),
isopropoxytitaniumtri(methyl acetoacetate),
isopropoxytitaniumtri(ethyl acetoacetate),
isobutoxytitaniumtri(methyl acetoacetate),
isobutoxytitaniumtri(ethyl acetoacetate);

As for titanium chelating compounds having a β-diketone chelate ligand, for example,
diisopropoxytitaniumbis(acetylacetodionate),
diisopropxytitaniumbis(2,4-heptane dionate),
dibutoxytitaniumbis(acetylacetonate),
dibutoxytitaniumbis(2,4-heptanedionate),
tributoxytitanium(acetylacetonate),
tributoxytitanium(2,4-heptanedionate),
isopropoxytitaniumtri(acetylacetonate),
isopropoxytitaniumtri(2,4-heptanedionate).
isobutoxytitaniumtri(acetylacetonate),
isobutoxytitaniumtri(2,4-heptanedionate);

As for aluminum chelating compounds having an acetoacetate chelate ligand, for example,
diisopropoxyaluminum(methyl acetoacetate),
diisopropoxyaluminum(ethyl acetoacetate),
diisopropoxyaluminum(propyl acetoacetate),
diisopropoxyaluminum(butyl acetoacetate),
dibutoxyaluminum(methyl acetoacetate),
dibutoxyaluminum(ethyl acetoacetate),
isopropoxyaluminumbis(methyl acetoacetate),
isopropoxyaluminumbis(ethyl acetoacetate),
isobutoxyaluminumbis(methyl acetoacetate),
isobutoxyaluminumbis(ethyl acetoacetate);

As for aluminum chelating compounds having β-diketone chelate ligand, for example,
diisopropoxyaluminum(acetylacetonate),
dibutoxyaluminum(2,4-heptanedionate),
dibutoxyaluminum(acetylacetonate),
dibutoxyaluminum(2,4-heptanedionate),
isopropoxyaluminumbis(acetylacetonate),
isopropoxyaluminumbis(2,4-heptanedionate),S
isobutoxyaluminumbis(acetylacetonate),
isobutoxyaluminumbis(2,4-heptanedionate);
etc. can be mentioned, however, the scope of the present invention is not limited to these.

Hereinbelow, preferable zirconium compounds are given.

First, as for zirconium chlating compounds having acetoacetate chelate ligand, for example,
diisopropoxyzirconiumbis(methyl acetoacetate),
diisopropoxyzirconiumbis(ethyl acetoacetate),
diisopropoxyzirconiumbis(propyl acetoacetate),
diisopropoxyzirconiumbis(butyl acetoacetate),
dibutoxyzirconiumbis(methyl acetoacetate)
dibutoxyzirconiumbis(ethyl acetoacetate),
triisopropoxyzirconium(methyl acetoacetate).
triisopropoxyzirconium(ethyl acetoacetate),
tributoxyzirconium(methyl acetoacetate),
tributoxyzirconium(ethyl acetoacetate),
isopropoxyzirconiumtri(methyl acetoacetate),
isopropoxyzirconiumtri(ethyl acetoacetate),
isobutoxyzirconiumtri(methyl acetoacetate),
isobutoxyzirconiumtri(ethyl acetoacetate);

As for zirconium chelating compounds having β-diketone chelating group, for example, diisopropoxyzirconiumbis(acetylacetonate),
diisopropoxyzirconiumbis(2,4-heptanedionate),
dibutoxyzirconiumbis(acetylacetonate),
dibutoxyzirconiumbis(2,4-heptanedionate),
triisopropoxyzirconium(acetylacetonate),
triisopropoxyzirconium(2,4-heptanedionate),S
tributoxyzirconium(acetylacetonate),
tributoxyzirconium(2,4-heptanedionate),
can be mentioned, however, the scope of the present invention is not limited to these.

The silane coupling agent is preferably a compound represented by the following formula.

$$(Z)_a(A)_bSi(Y)_c.$$

Z represents a hydrolysis group, such as an alkoxy group, a halogen atom or an amino group;
A represents an alkyl group or an aryl group; and
Y represents an organic functional group;
a and c independently represent an integer of not less than 1;
b represents an integer of not less than 0; provided that the sum of a, b and c is 4. Allowable species of the terminal group of the organic functional group Y, that effects the characteristics of the photoreceptor, includes, 1) $CH_2{=}C(CH_3)COO-$, 2) 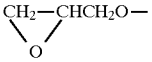

3) 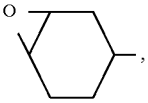 , 4) $-NH_2$,

5) $NH_2(CH_2)_nNH-$ n is an integer of not more than 10, 6) HS-, 7) Cl- and 8) N-phenylamino group.
Examples of the compounds includes
γ-aminopropyltrimethoxy silane,
N-β-(aminoethyl)-γ-amino propyltrimethoxy silane,
N-phenyl-γ-amino propyltrimethoxy silane,
γ-methacryloxypropyltrimethoxysilane,
γ-glycidoxy propyltrimethoxy silane,
β-(3,4 epoxycyclohexyl)ethyltrimethoxy silane,
γ-chloro propyltrimethoxy silane, and
γ-mercapto propyltrimethoxy silane.
among these compounds, compounds having an organic functional group having methacryloxy group, amino group or N-phenylamino group at the end of the group show good characteristics such as both an electrical potential and image characteristics.

Preferable examples of the silane coupling agent are those whose organic functional group Y is $-BOOC(R')C{=}CH_2$, —BNHR" or $BNH_2$ group wherein R' is an alkyl group, R" is an alkyl or aryl group, B is an alkylene group or an alkylene group containing —O—, —NH— or —CO—.

The methacryloxy group is a group represented by $CH_2{=}C(R')COO-$, wherein R' is an alkyl group, preferably an alkyl group having three or less carbon atoms. Specific examples of the silane coupling agent having the methacryloxy group are as follows:
γ-methylmethacryloxypropyltrimethoxysilane,
γ-methylmethacryloxypropyltriethoxysilane,
γ-methylmethacryloxypropyltrimethoxysilane,
γ-methylmethacryloxypropylmethoxydimethoxysilane,
γ-methylmethacryloxypropylmethoxydiethoxysilane.

By the use of the silane coupling agent having these methacryloxy group, an interlayer excellent in both film-forming performance and image properties can be obtained. What is worthy of special mention concerning the silane coupling agent having the end methacryloxy group, is stability of electro-potential. An interlayer can be obtained which has extremely stable potential properties such as low residual potential even when the repeated copying operation was carried out.

Among the above-mentioned silane coupling agent, those which show excellent properties have a methacryloxy group or an amino group, i.e., an $-NH_2$ group or an —NHR" group at the terminal of the organic functional group Y. In the above, R" represents an alkyl group or an aryl group, and, preferably, an alkyl group having six or less carbon atoms or an aryl group containing eight or less carbon atoms.

The silane coupling agent having this amino group at the end thereof, is more reactive than other silane coupling agents which do not have this structure, and network structuring in the interlayer tends to proceed more rapidly by polymerization with a metal compound during formation of the interlayer. It is assumed that this high reactivity greatly contributes to the restriction of the image defects, more specifically, white spots or black spots, and, in this respect, this type of silane coupling agents come to have superior properties to many other silane coupling agents.

Among these, primary and secondary amino groups show very high reactivity and primary amino group $-NH_2$ shows particularly high reactivity. Accordingly, they have excellent image defect-restraining ability.

As for specific examples of the organic functional group having an $-NH_2$ group at the terminal portion thereof, for example,
aminopropyl group,
aminoethyl group,
aminobutyl group,
can be mentioned and for the silane coupling agents having this organic functional group, for example,
γ-aminopropyltrimethoxysilane,
γ-aminopropyltriethoxysilane,
γ-aminopropylmethyldimethoxysilane,
γ-aminopropylmethyldiethoxysilane,
can be mentioned.

As for the structure of the organic functional group other than the terminal group thereof, there is no specific limitation. Other than the alkylene group or $-(CH_2)_n-$ group above-mentioned, an alkylene group containing a different kind of structuring unit, for example, an imino group, a carbonyl group and oxygen, such as a $-(CH_2)_m-NH-(CH_2)_n-$ group and a $-(CH_2)_n-NH-CO-$ group in which m and n are preferably integers of ten or less.

This organic functional group includes, for example,
N-β-(aminoethyl)-γ-aminopropyl group,
N-β-(aminopropyl)-γ-aminopropyl group,
N-β-(aminoethyl)-γ-aminobutyl group,
γ-ureidopropyl group,
can be mentioned, and as for the silane coupling agent having this organic functional group, for example,
N-β-(aminoethyl)-γ-aminopropyltrimethoxysilane
N-β-(aminoethyl)-γ-aminopropyltriethoxysilane
N-β-(aminoethyl)-γ-aminopropylmethyldimethoxysilane
N-β-(aminoethyl)-γ-aminopropylmethyldiethoxysilane
N-β-(aminopropyl)-γ-aminopropyltrimethoxysilane
N-β-(aminoethyl)-γ-aminobutyltrimethoxysilane
γ-ureidopropyltrimethoxysilane,
γ-ureidopropyltriethoxysilane,
can be mentioned.

In the case where a photoreceptor is loaded on an image forming apparatus with high line speed and is used repeatedly, excellent potential properties such as high sensitivity with less increase in the residual potential is obtainable when it consists only of an aliphatic hydrocarbon chain or a —$(CH_2)_n$— group.

As the aliphatic or aromatic hydrocarbon group, which is introduced to the amino group, for example, alkyl group such as methyl group, ethyl group, propyl group and butyl group; a residue of an unsaturated aliphatic hydrocarbon group such as a vinyl group and an allyl group; an aryl group such as phenyl group, toluyl group, xylyl group and naphthyl group can be mentioned as examples, however the scope of the present invention is not limited to these. Moreover, these groups may be substituted by any one of these groups.

For the organic functional group having a secondary amino group at the terminal portion, for example,
N-methyl-γ-aminopropyl group,
N-ethyl-γ-aminopropyl group,
N-vinyl-γ-aminopropyl group,
N-allyl-γ-aminopropyl group,
N-phenyl-γ-aminopropyl group,
N-toluyl-γ-aminopropyl group,
can be mentioned, and as the silane coupling agent having this organic functional group, for example,
N-methyl-γ-aminopropyltrimethoxysilane,
N-ethyl-γ-aminopropyltrimethoxysilane,
N-vinyl-γ-aminopropyltrimethoxysilane,
N-allyl-γ-aminopropyltrimethoxysilane,
N-phenyl-γ-aminopropyltrimethoxysilane,
N-toluyl-γ-aminopropyltrimethoxysilane,
can be mentioned.

The interlayer according to the present invention is produced by coating a solution, formerly referred to as a coating solution, which contains the component materials, i.e., an organic metal compound and a silane coupling agent, dissolved in a solvent, and drying it. As the solvent, for example, alcohols such as methanol, ethanol propanol and butanol; an aromatic hydrocarbons such as toluene; and esters such as ethyl acetate cellosolve acetate can be mentioned. Toluene is an example most preferably useable solvent. These solvents can be used either singly or two or more kinds in combination. Further, if necessary, they can be mixed with water.

The ratio of the compounds represented by formulae (1) and (2) is from 5:95 to 95:5. Water up to abut 10% of the solvent can be added to the solvent.

Drying conditions of the coated layer are, usually between 10° and 250° C. and, more preferably, between 90° and 200° C. with respect to drying time, and usually between 5 minutes and 5 hours and, more preferably between 20 minutes and 2 hours with respect to the drying period; and the drying may be performed either under ventilated or non-ventilated condition.

A photoconductive layer is usually provided on the interlayer. The photoconductive layer may consist of a single-layer structure or a multi-layer structure. Preferable photoconductive layer is that has the so called function separated type multi-layer structure having a carrier generation layer and a carrier transfer layer.

The carrier generation layer is formed by dispersing the carrier generation material (CGM) in a binder resin. Preferably a metal or non-metal phthalocyanine compound is used as the CGM.

The carrier generation material may be used by mixing two types of them if necessary.

It is preferably to use a kind of metal phthalocyanine compound, oxotitanylphthalocyanine (TiOPc), hydroxygalliumphthalocyanine or methoxygalliumphthalocyanine, shown bellow.

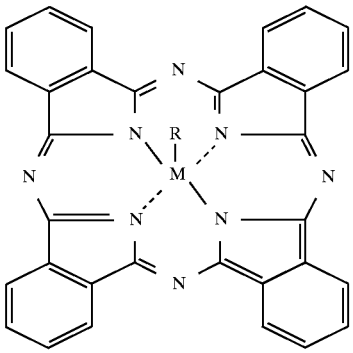

| | | M—R |
|---|---|---|
| G-1 | oxotitanylphthalocyanine | Ti=O |
| G-2 | hydroxygalliumphthalocyanine | Ga—O—H |
| G-3 | methoxygalliumphthalocyanine | Ga—O—$CH_3$ |

As the above-mentioned TiOPc (M–R: Ti=O), a crystalline Y-type oxotitanyl phthalocyanine which has the maximum peak at 27.3±0.2° of X-ray diffraction spectrum (Bragg angle 2θ) on the Cu-Kα line is specifically preferable.

As the hydroxy gallium phthalocyanine crystal, the following are cited: a) hydroxy gallium phthalocyanine crystal having a strong diffraction peak at Bragg angles (2θ±0.2°) of 7.7°, 16.5°, 25.1° and 26.6°; b) hydroxy gallium phthalocyanine crystal having a strong diffraction peak at Bragg angles (2θ±0.2°) of 7.9°, 16.5°, 24.4° and 27.6°; c) hydroxy gallium phthalocyanine crystal having strong diffraction peak at Bragg angles (2θ±0.2°) of 7.0, 7.5°, 10.5°, 11.7°, 12.7°, 17.3°, 18.1°, 24.5°, 26.2° and 27.1° in the above-mentioned X-ray diffraction spectral; d) hydroxy gallium phthalocyanine crystal having a strong diffraction peak at Bragg angles (2θ±0.2°) of 7.5°, 9.9°, 12.5°, 16.3°, 18.6°, 25.1° and 28.3° in the above-mentioned X-ray diffraction spectral and e) hydroxy gallium phthalocyanine crystal having strong diffraction peak at the Bragg angles (2θ±0.2°) of 6.8°, 12.8°, 15.8° and 26.0° in the above-mentioned X-ray diffraction spectral are preferably used.

With regard to methoxy gallium phthalocyanine, methoxy gallium phthalocyanine crystals having strong diffraction peaks at Bragg angles (2θ±0.2°) of 7.7°, 16.5°, 25.1° and 26.6° on the line Cu-Kα is especially preferable.

As for binder resins which are applicable in the carrier generation layer, for example, polystyrene resins, polyethylene resins, polypropylene resins, acryl resins, methacryl resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymer resins containing two one more repeating unit of the above-mentioned resins, for example, vinyl chloride-vinyl acetate copolymer resins, vinyl chloride-vinyl acetate-maleic acid anhydride copolymer resin; polymeric organic semi-conductors such as poly-N-vinyl carbazoles can be mentioned, however, again, the scope of the present invention is not limited to these.

The carrier transportation layer is composed of either singly with a carrier transportation material(CTM) itself or with CTM together with a binder resin. As for the CTM, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofurane derivatives, acrydine derivatives, phenadine derivatives, aminostilbene derivatives, triarylamine derivatives, phenylenediamine derivatives, stilbene derivatives, benzidine derivatives, poly-N-vinylcarbazoles, poly-1-vinylpyrene, poly-9-vinylanthrathene can be mentioned, however the scope of the invention is not limited to these. Further, these compounds may be used either individually or two or more compounds in combination.

Further, for the resin which is applicable to the carrier transportation layer, for example, polycarbonate resins, polyacrylate resins, polyester resins, polystyrene resins, styrene-acrylonitrile copolymer resins, polymethacrylate resins, styrene-methacrylate copolymer resins can be mentioned. However the scope of the present invention is not limited to these.

In order to reduce fatigue of the photoreceptor when it is subjected to repeated use, or for the purpose of improving durability, conventionally known anti-oxidants, ultraviolet-ray absorbents, electron receptive materials, the surface modifiers, plasticizers, anti-environment-dependence reducing agent may optionally be incorporated in any of constituent layers of the photoreceptor at an appropriate quantity.

Further, for the purpose of improving durability, if necessary, a non-light-sensitive layer such as a protective layer may optionally be arranged other than the photoconductive layer. Here, the word photoconductive layer is called including the protective layer, in case especially noted otherwise.

As for the method of coating the coating solution, for example, a dipping-coating method, a spray-coating method, a blade-coating method, a spinner coating method, a bead coating method and a curtain coating method can be used.

When an organic photoreceptor is prepared by the use of a dip coating method, a conductive support is dipped in a coating solution tank and drawn up. Therefore, a thick layer portion is formed at the end portion of the substrate of the photoreceptor.

An intermediate layer is hardened due to hardening process such as heating after being coated so that it becomes insoluble with a solvent. Therefore, it is considerably difficult to remove the thick layer portion after the hardening process.

An example of removing excessive coating composition is a method using an organic solvent or using an organic solvent and a wiping member such as a sponge and a brush in combination. In FIGS. 3(*a*), 3(*b*) and 3(*c*) the substrate 30 having coated with the intermediate layer coating composition, is dipped in a solvent 32 in a tank 33, where the substrate is turned in contact with a wiper 31 made of nylon. The excess coating composition at the thick layer portion is removed.

As a solvent used therefor, branched alcohol, straight-chained alcohol having 4 or more carbon atoms and aromatic hydrocarbons are preferable. As practical examples, isopropyl alcohol, butanol, toluene and xylene are cited.

If ketones such as acetone and methylethylketone or halogen-type solvents such as methylene chloride and dichloroethane are used, deterioration of the photoreceptor property at a portion where it is exposed to solvent vapor is suspicious. Practically, deterioration of sensitivity and uneven image density due to rise of light exposure potential caused by repeated partial using are caused.

Figure 2:
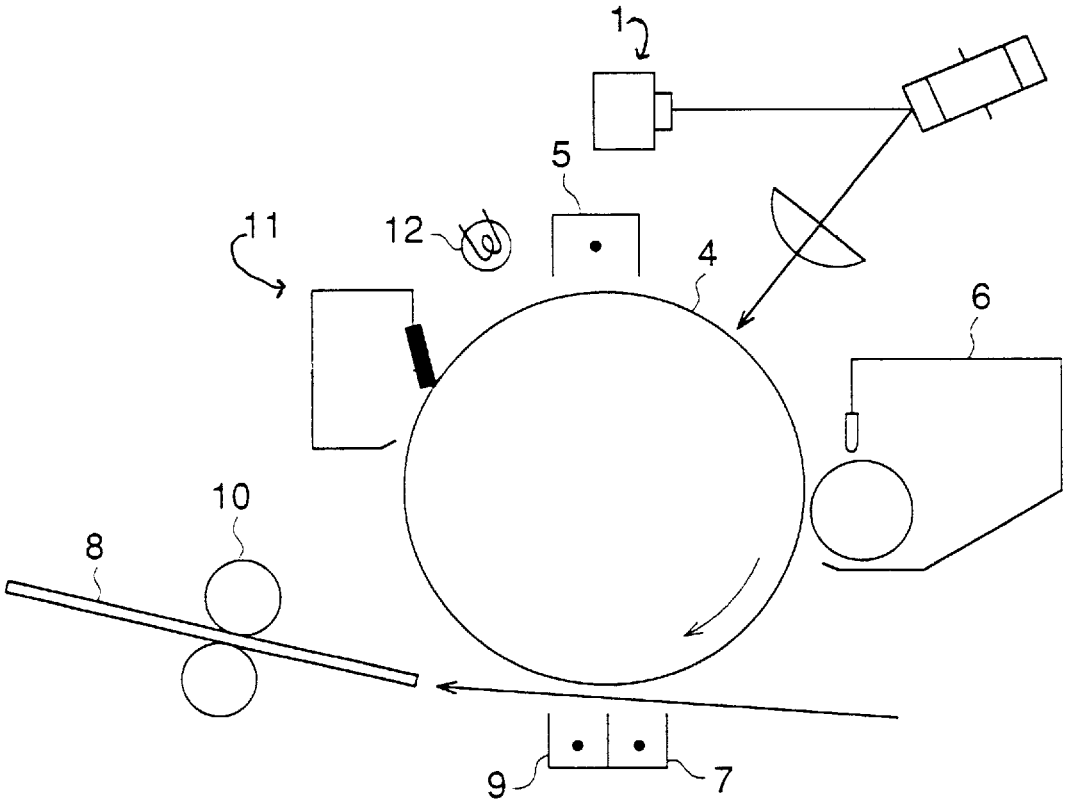
FIG. 2 is a cross sectional structural diagram showing an example of the image forming apparatus of the invention.

Next, process of the present invention is explained, for illustrative purpose, with reference to a digital copier which is shown in FIG. 2 and in which the image-forming process is employed.

As mentioned above, the photoreceptor comprising the hardened interlayer is capable of exerting its effects in the image-forming processes, which include reverse development process such as in printers or digital copying machine.

The image forming apparatus for forming plural sheets of images comprises at least a charging means, an imagewise exposure means, a developing means, a transferring means, a separation means and a cleaning means, wherein a photoreceptor comprises an intermediate layer and a photosensitive layer in this order on a conductive support, aforesaid intermediate layer contains at least one of an organic metal compound and a silane coupling agent or a product produced therefrom and its membranaceous index is 0.5 or more and 10 or less.

The image forming method which forms plural sheets of images by repeating, comprises at least a charging means, an imagewise exposure means, a developing means, a transferring means, a separation means and a cleaning process, wherein a photoreceptor comprises an intermediate layer and a photosensitive layer in this order on a conductive support, aforesaid intermediate layer contains at least one of an organic metal compound and a silane coupling agent or a product therefrom and its membranaceous index is 0.5 or more and 10 or less.

In the image-forming apparatus illustrated in FIG. 2, an original document is irradiated by a light from a light source, which are not shown in the Figure, and reflected light is converted into an electrical signal in the image reading section. And the image data are sent to an image-writing section 1.

On the other hand, photoreceptor drum 4, which is in charge of image formation is uniformly electrified by a electrification unit 5 with corona discharge, and consequently, imagewise light exposure is conducted on the photoreceptor drum 4 from a laser light source of the image writing section 1, and the electrostatic latent image is reversibly developed with a developing unit 6, then the image is transferred on a recording paper by means of transfer pole 7. The recording paper 8 is separated by means of separating pole 9, from the photoreceptor drum, which is then subjected by cleaning by means of cleaning device 11. The numeral 12 denotes pretransfer exposing lamp, that is provided at a position after the separating pole 9 and may be provided before the cleaning device 11.

The illustration is made as for single color process, it is applied to multi color such as two color image forming. For an electrical signal corresponding to separated color, which is separated in an image reading process, repeating process of charging, image writing by laser light exposing and development by corresponding color toner, The four color toner images of yellow, magenta, cyan and black toner images are transferred at a time onto a recording paper.

Moreover, concerning the method of the toner image formation or the method of transfer onto the recording paper, a different method may also be applied.

Still further, in addition to the above, image information may be memorized in an image memory such as ROM, floppy disk in advance and the image information may be taken out from the image memory depending necessity, and outputted to the image forming section. Accordingly, the image formation process according to the present invention includes apparatuses, in which as in the present example, there is no image-reading section and information is stored in a memory from a computer and the information is outputted in the image forming section is included within the scope of the image formation process according to the present invention. As the most popular example of such image formation process, LED printers or LBP (laser beam printer) can be mentioned.

EXAMPLE

Hereunder, the present invention will be explained in detail referring to examples.

1. Preparation of a photoreceptor

Photoreceptor preparation example 1

| (Intermediate layer) | |
|---|---|
| By mixing | |
| Titanium chelating compound TC-750 (produced by Matsumoto Seiyaku Co., Ltd.) (A-1) | 20 parts by weight |
| Silane coupling agent KBM-503 (produced by ShinEtsu Chemical Co., Ltd.) (B-1) | 13 parts by weight |
| and diluting with | |
| 2-propanol | 100 parts by weight |
| Pure water | 3 parts by weight |
| an intermediate layer coating solution was obtained. | |

By the use of a tube-type substrate made of Al-Mg alloy (according to JIS 5805) whose diameter is 80 mm, an intermediate layer was dip-coated. The aforesaid layer was subjected to heating at 150° C. and 30 minutes so that an intermediate layer whose thickness was 1.0 μm was obtained.

| (Carrier generation layer) | |
|---|---|
| Y-type oxotitanyl phthalocyanine (G-1) | 4 parts by weight |
| Silicone resin solution KR-5240 (produced by ShinEtsu Chemical Co., Ltd.) | 45 parts by weight |
| 2-butanone | 100 parts by weight |

were mixed, and then, the resulting mixture was dispersed for 10 hours using a sandmill so that a carrier generation layer coating solution was obtained. This coating solution was dip-coated on the above-mentioned intermediate layer so that a carrier generation layer of 0.25 μm was obtained.

| (Carrier transport layer) | |
|---|---|
| Carrier transport material (T-1) | 8 parts by weight |
| Bisphenol type Z polycarbonate Z-300 (produced by Mitsubishi Gas Chemical Co., Ltd.) | 12 parts by weight |
| Anti-oxidation agent LS2626 (produced Sankyo Co., Ltd.) | 0.04 parts by weight |
| 1,2-dichloroethane | 100 parts by weight |

T-1

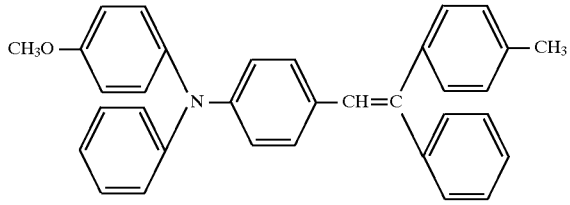

Photoreceptor preparation example 2

In the same manner as in photoreceptor preparation example 1, photoreceptor preparation example 2 was prepared by modifying that the substrate made of Al-Mn alloy (according to JIS 3003) is use, and the organic metal compound and the silane coupling agent used for forming the intermediate layer as shown in the following Table 1.

Photoreceptor preparation examples 3, 4 and 5

In the same manner as in photoreceptor preparation example 1 except that the carrier generation material or the intermediate layer were modified, photoreceptor preparation examples 3, 4 and 5 were prepared.

Comparative photoreceptor preparation example 1

In the same manner as in photoreceptor preparation example 1, comparative photoreceptor 1 was prepared except that an intermediate layer was coated in the following manner.

| (Intermediate layer) | |
|---|---|
| Zirconium chelating compound ZC-540 (produced by Matsumoto Seiyaku Co., Ltd.) (A-3) | 20 parts by weight |
| Silane coupling agent KBM-503 (produced by ShinEtsu Chemical Co., Ltd.) (B-1) | 13 parts by weight |
| were mixed, and then, the resulting mixture was diluted with | |
| 2-propanol | 100 parts by weight |
| Pure water | 3 parts by weight |

By the use of a tube-type substrate made of aluminum alloy whose diameter is 80 mm, an intermediate layer was dip-coated. The aforesaid layer was subjected to heating at 150° C. and 30 minutes so that an intermediate layer of 1.0 μm was obtained.

Comparative photoreceptor preparation examples 2 and 3

In the same manner as in photoreceptor preparation example 1 except that the intermediate layer drying condition was changed as shown in Table 1, comparative photoreceptor preparation example 2 and 3 were obtained.

Evaluation

For the image forming apparatus, a copying machine Konica U-BIX 4045 produced by Konica Corporation was modified to a digital image exposure system using a semiconductor laser light source (780 nm) to be used.

At ambient room condition, testing of actual copying for 100,000 times was conducted. The membranous index was measured by the use of FT-IR (a micro-Fourier transform infrared spectrometer produced by Japan Spectral Janssen), after wiping the resulting carrier transport layer and a carrier generation layer of the photoreceptor with methylenechloride.

Table 1 shows photoreceptor preparation conditions and the results thereof.

(Evaluation standards)

Photoreceptor carrier potential characteristics $V_L$: Potential at an exposure portion under full lightening of the light for exposure.

was measured by installing a potentiometer at a position of a developing device of the image forming apparatus. The lower the $V_L$ value is, the better.

Evaluation of image quality

A: No defects such as spotting were observed on any image which is extremely favorable B: There were slight image defects partially, which however, pose no problem in practical use.

C: There are easily apparent image defects so that it is not suitable for practical use.

Comparative Photoreceptor Examples 1, 2 and 3 each has a membranous index other than the inventive samples because of combination of the chelate compound, silane coupling agent and drying condition is not adequately selected.

TABLE 1

| | Chelating Compound | Silane coupling agent | CGM | Intermediate layer drying | Membraneous index | Repetitive potential $V_L$ (V) At Start | After copying 100,000 sheets | Image quality |
|---|---|---|---|---|---|---|---|---|
| Photoreceptor example-1 | A-1 | B-1 | Y-TioPc | 150° C./30 min. | 1.2 | 30 | 40 | A |
| Photoreceptor example-2 | A-2 | B-1 | Y-TioPc | 150° C./30 min. | 1.8 | 20 | 30 | A |
| Photoreceptor example-3 | A-1 | B-2 | Potassium methoxy Pc | 150° C./30 min. | 2.1 | 40 | 50 | A |
| Photoreceptor example-4 | A-1 | B-1 | Potassium hydoxy Pc | 150° C./30 min. | 1.4 | 40 | 50 | A |
| Photoreceptor example-5 | A-1 | B-1 | Y-TioPc | 90° C./30 min. | 7.0 | 65 | 90 | A |
| Comparative Photoreceptor example-1 | A-3 | B-1 | Y-TioPc | 150° C./30 min. | 0.3 | 110 | 170 | C(spot) |
| Comparative Photoreceptor example-2 | A-1 | B-1 | Y-TioPc | 60° C./30 min. | 11 | 70 | 250 | C(spot) |
| Comparative Photoreceptor example-3 | A-1 | B-1 | Y-TioPc | 200° C./200 min. | 0.4 | 70 | 110 | C(spot) |

(Pc is an obbreviation of phthalocyanine)

TC750 $(H_7C_3O)_2-Ti$ 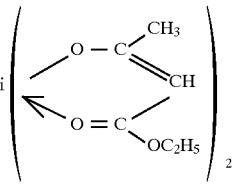 A-1

$(H_7C_3O)_2-Ti$ 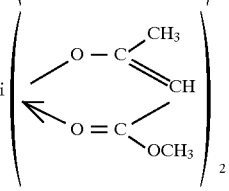 A-2

ZC-540 $(C_4H_9O)_3-Zr$ 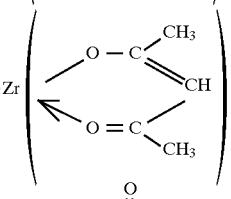 A-3

KBM503 $(H_3CO)_3-Si-C_3H_6-OC(=O)-C(CH_3)=CH_2$ B-1

KBM903 $(H_3CO)_3-Si-C_3H_6NH_2$ B-2

As shown in Table 1, all the examples having an adequate membranaceous index render no practical problems in terms of characteristics.

On the contrary, comparative examples having membranaceous index outside of the invention have practical problems in terms of charge property or image quality. Therefore, it can be understood that the membranous index within the present invention is important.

Owing to the present invention, it is possible to offer an electrophotographic photoreceptor having low residual potential wherein no image defects such as spots are caused over a long period of use, an image forming method and an image forming apparatus using the same.

We claim:

1. An electrophotographic photoreceptor comprising a conductive support having thereon an intermediate layer and a photosensitive layer in this order from the support, wherein said intermediate layer contains at least one of an organic metal compound and a silane coupling agent or a product therefrom and its membranaceous index is 1.0 to 10.

2. The electrophotographic photoreceptor according to claim 1, wherein said intermediate layer contains both an organic metal compound represented by following Formula (1) and a silane coupling agent represented by following Formula (2) or a product produced from either:

$$(RO)_mMX_n \quad (1)$$

$$(Z)_a(A)_bSi(Y)_c \quad (2)$$

wherein, in Formula (1), R represents an alkyl group; M represents zirconium, titanium or aluminum; X represents an acetoacetic acid ester residual group or a β diketone residual group; and m and n represent integers of one or more, provided that m+n is 4 when M is zirconium or titanium and m+n is 3 when M is aluminum;

in Formula (2), Z represents a hydrolysis group; A represents an alkyl group or an aryl group; Y represents —BOOCC(R')=$CH_2$, —BNHR" or —$BNH_2$; R' represents an alkyl group; R" represents an alkyl group or an aryl group; B represents an alkylene group or an alkylene group containing —O—, —NH—, —NR'— and —CO—; a and c represent integers of 1 or more; b represents an integer of 0 or more; and a+b+c represent 4.

3. The electrophotographic photoreceptor according to claim 2, wherein M is titanium or aluminum.

4. The electrophotographic photoreceptor according to claim 2, wherein M is zirconium and the membranaceous index is 1.5 to 7.

5. The electrophotographic photoreceptor according to claim 1, wherein said photosensitive layer contains a phthalocyanine compound.

6. The electrophotographic photoreceptor according to claim 1, wherein said photosensitive layer contains oxotitanylphthalocyanine.

7. The electrophotographic photoreceptor according to claim 6, wherein the oxotitanylphthalocyanine which has the maximum peak at 27.3±0.2° of X-ray diffraction spectrum (Bragg angle 2θ) on the Cu-Kα line.

8. The electrophotographic photoreceptor according to claim 1, wherein the membranaceous index is 1.2 to 7.

* * * * *